US011452185B2

(12) United States Patent
Liu et al.

(10) Patent No.: US 11,452,185 B2
(45) Date of Patent: Sep. 20, 2022

(54) LIGHTING APPARATUS

(71) Applicant: XIAMEN LEEDARSON LIGHTING CO., LTD, Fujian (CN)

(72) Inventors: Wei Liu, Fujian (CN); Qiqiang Lin, Fujian (CN); Yibin Chen, Fujian (CN); Fujie Chen, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/212,668

(22) Filed: Mar. 25, 2021

(65) Prior Publication Data

US 2021/0307138 A1 Sep. 30, 2021

(51) Int. Cl.

| | |
|---|---|
| ***H05B 45/14*** | (2020.01) |
| ***H05B 45/325*** | (2020.01) |
| ***H05B 45/345*** | (2020.01) |
| ***H05B 45/37*** | (2020.01) |
| ***H05B 47/19*** | (2020.01) |

(52) U.S. Cl.

CPC ..... *H05B 45/14* (2020.01); *H05B 45/325* (2020.01); *H05B 45/345* (2020.01); *H05B 45/37* (2020.01); *H05B 47/19* (2020.01)

(58) Field of Classification Search

None

See application file for complete search history.

(56) References Cited

U.S. PATENT DOCUMENTS

| | | | | |
|---|---|---|---|---|
| 9,900,949 | B1 * | 2/2018 | Zhang | H05B 45/37 |
| 2013/0307434 | A1 * | 11/2013 | Zhang | H05B 45/382 315/219 |
| 2016/0119992 | A1 * | 4/2016 | Tyrrell | H05B 45/3725 315/200 R |
| 2017/0196062 | A1 * | 7/2017 | Wang | H05B 45/3725 |
| 2021/0410245 | A1 * | 12/2021 | Li | H05B 47/19 |

* cited by examiner

*Primary Examiner* — Anh Q Tran

(74) *Attorney, Agent, or Firm* — Chun-Ming Shih; Lanway IPR Services

(57) ABSTRACT

The lighting apparatus includes a LED module, a constant current source, a bridge rectifier, a silicon-controlled rectifier, a wireless module and a detector. The lighting apparatus receives an alternating current power to generate a light. The constant current source provides a driving current to the LED module. The bridge rectifier converts the alternating current power of a first frequency to a direct current power with a second frequency. The second frequency is two times of the first frequency. The silicon-controlled rectifier is connected to the alternating current power and the bridge rectifier for adjusting the direct current power with a chopping signal. The wireless module receives an external control signal. The detector generates a dimming control signal supplied to the constant current source to adjust the driving current according to both the external control signal and the chopping signal.

18 Claims, 8 Drawing Sheets

LIGHTING APPARATUS

FIELD

The present invention is related to a lighting apparatus, and more particularly related to a lighting apparatus with a smart control design.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

It is important to provide a flexible design of light devices to meet requirements of people.

When the control may be made from several sources, it is beneficial to make the design system more clever to provide more value to users.

SUMMARY

In some embodiments, a lighting apparatus includes a LED module, a constant current source, a bridge rectifier, a silicon-controlled rectifier, a wireless module and a detector.

The lighting apparatus receives an alternating current power to generate a light.

The constant current source provides a driving current to the LED module.

The bridge rectifier converts the alternating current power of a first frequency to a direct current power with a second frequency.

The second frequency is two times of the first frequency.

The silicon-controlled rectifier is connected to the alternating current power and the bridge rectifier for adjusting the direct current power with a chopping signal.

The wireless module receives an external control signal.

The detector generates a dimming control signal supplied to the constant current source to adjust the driving current according to both the external control signal and the chopping signal.

In some embodiments, the lighting apparatus may also include a DC-DC converter for converting the direct current power source to a constant direct current supplied to the constant current source.

In some embodiments, the silicon-controlled rectifier is a TRIAC device, and the chopping signal is a TRIAC signal corresponding to a conductive angle for conducting a ratio of a current of the bridge rectifier.

In some embodiments, the dimming control signal is a PWM signal for adjusting the driving current based on a duty ratio of the PWM signal.

In some embodiments, the lighting apparatus may also include a power supply for providing a working power to the wireless module and the detector.

In some embodiments, the detector has a priority setting for determining a priority order between the external control signal and the chopping signal.

In some embodiments, the priority setting controls the detector to output the dimming control signal completely based on the external control signal.

In some embodiments, the detector determines the dimming control signal according to the chopping signal with a ratio determined by the external control signal.

In some embodiments, when the external control signal is not received, the detector uses the chopping signal to determine the dimming control signal.

In some embodiments, the lighting apparatus may also include a manual switch connected to the detector for changing the priority setting.

In some embodiments, the chopping signal is converted to a digital value by the detector to determine the dimming control signal.

In some embodiments, the digital value corresponding to multiple control values respectively corresponding to multiple LED devices of the LED module to generate a mixed light.

In some embodiments, the multiple LED devices have different color temperatures, and a mixed color temperature of the mixed light is adjusted by changing the multiple control values.

In some embodiments, the driving current includes multiple sub driving currents respectively supplied to the multiple LED devices.

In some embodiments, the detector converted the chopping signal to the wireless module to generate a status signal sent to an external device.

In some embodiments, the external device generates the external control signal based on the status signal.

The external control signal has a set of commands sent to the detector.

In some embodiments, the detector determines the dimming control signal based on the set of commands to generate multiple sub driving currents to multiple LED devices of the LED module.

In some embodiments, different chopping signals correspond to different set of commands.

The external device references a table to perform the mapping between the status signal and the set of commands.

In some embodiments, the external control signal has a value to disable reference to the chopping signal of the detector.

In some embodiments, the wireless module has a detachable antenna module and a wireless processor.

The detachable antenna module is replaced with a different detachable antenna module to change a different wireless protocol but with the same wireless processor.

DETAILED DESCRIPTION

Figure 8:
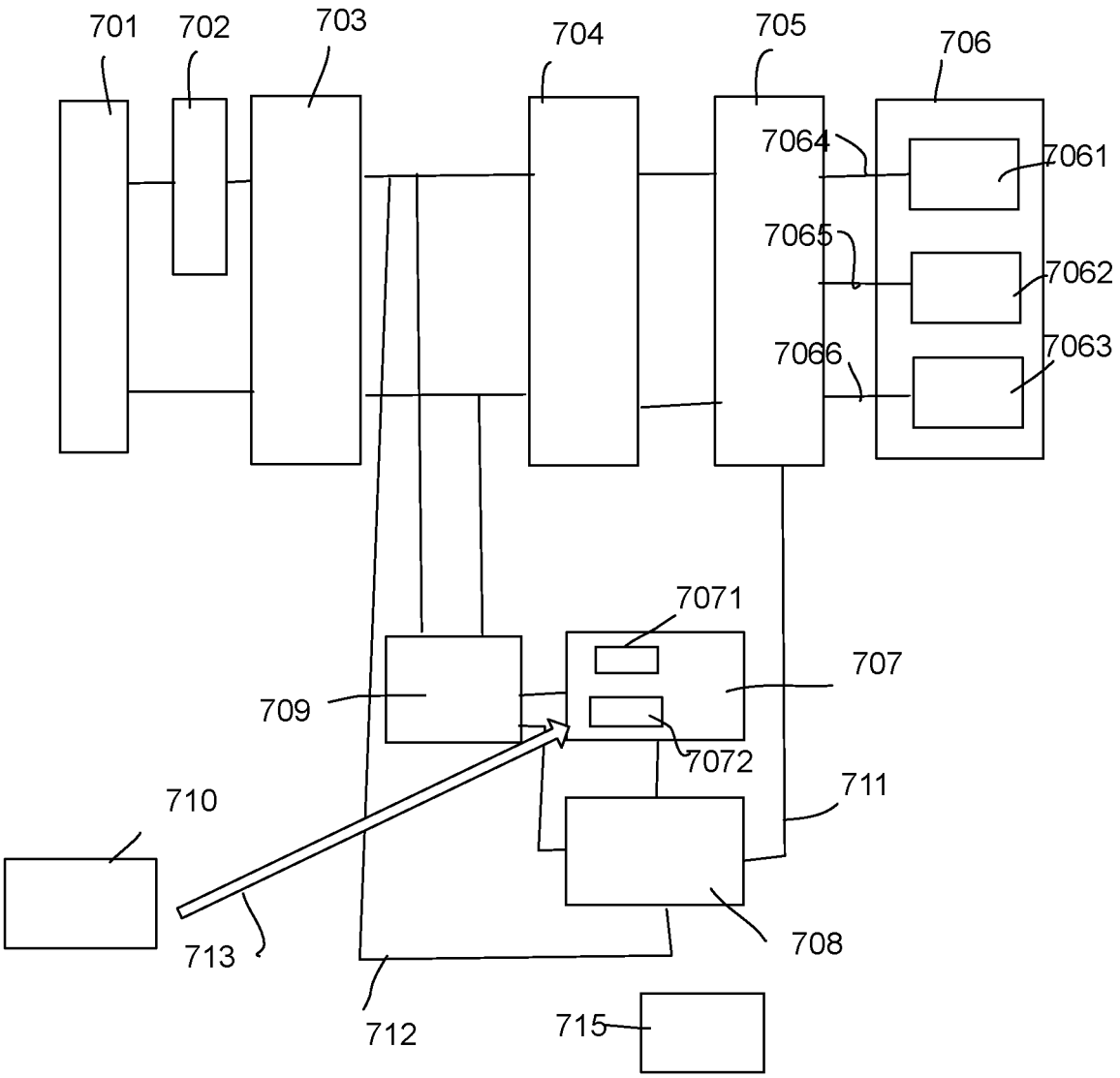
FIG. 8 illustrates a general embodiment of a lighting apparatus.

Please refer to FIG. 8, which illustrates a lighting apparatus embodiment. The lighting apparatus includes a LED module 706, a constant current source 706, a bridge rectifier 703, a silicon-controlled rectifier 702, a wireless module 707 and a detector 708.

The lighting apparatus receives an alternating current power 701 to generate a light. The light is generated by the LED module 706, known to persons of ordinary skilled in the art, and thus not illustrated on FIG. 8.

The LED module 706 may include multiple LED devices 7061, 7062, 7063 of the same or different types. For example, when different types of LED devices are used, different driving currents may be supplied to these LED devices to mix a required color or a required color temperature.

The constant current source 705 provides a driving current that includes three sub driving currents 7064, 7065, 7066 to three LED devices 7061, 7062, 7063 of the LED module 706.

The bridge rectifier 703 converts the alternating current power 701 of a first frequency to a direct current power with a second frequency. For example, the input alternating current power is 50 Hz 110V alternating current power. The bridge rectifier 703 converts the alternating current power to a 100 Hz direct current power. In other words, there is a variation on the direct current power and the changing frequency is 100 Hz. Compared with half wave rectifier that cuts half of input of alternating current input, such rectifier saves more power during conversion. In some other embodiments, half wave rectifier may be used.

The second frequency is two times of the first frequency.

The silicon-controlled rectifier is connected to the alternating current power and the bridge rectifier for adjusting the direct current power with a chopping signal. TRIAC device is an example of such silicon-controlled rectifier. The TRIAC device is connected to a rotator device to generate a TRIAC control signal that determines a conductive angle so as to control a volume of the current generated by the bridge rectifier 703.

The wireless module 707 receives an external control signal from an external device 710 like a remote server, a remote control, a mobile phone or other control device.

The detector 708 generates a dimming control signal 711 supplied to the constant current source 705 to adjust the driving current according to both the external control signal 713 and the chopping signal 713. The chopping signal 713 is hidden in the power signal and may be extracted from the signal line. FIG. 8 illustrates a way to obtain the chopping signal related to a conductive angle of the silicon control rectifier.

In other words, the detector may reference both the chopping signal derived from the silicon-controlled rectifier and the external control signal from a remote device.

The silicon-controlled rectifier and the constant current source are known to persons of ordinary skilled in the art and are not repeated for describing their examples for brevity.

In some embodiments, the lighting apparatus may also include a DC-DC converter 704 for converting the direct current power source to a constant direct current supplied to the constant current source 705. For example, the DC-DC converter converts a low voltage DC power to a high voltage DC power. The DC-DC convert in this example is a constant voltage circuit, which is also known to persons skilled in the art and is not explained in more details for brevity. The key of the present invention is not on these separate components but on how to combine these components.

In some embodiments, the silicon-controlled rectifier is a TRIAC device, and the chopping signal is a TRIAC signal corresponding to a conductive angle for conducting a ratio of a current of the bridge rectifier. TRIAC circuits are widely used, and very common in AC power control applications. These circuits have the ability to switch high voltages, as well as very high levels of current in the two parts of an AC waveform. They are semiconductor devices, similar to a diode.

TRIAC's ability to switch high voltages makes it an ideal choice for use in diverse electrical control applications. This means it can work to suit everyday lighting-control needs. TRIAC circuits are used for more than just domestic lighting though, they are also utilized when controlling fans and small motors, and also in other AC switching and control applications.

TRIAC stands for Triode for Alternating Current, and is a switch that is used to control power. When used in lighting applications, it's commonly referred to as 'TRIAC dimming'. TRIAC control works via a gate electrode when a positive or negative voltage is applied.

Triggering the circuit allows conduction of electricity until the current falls below the intended threshold. In this case, a TRIAC allows for high voltage to pass through with very small control currents.

Using phase control, a TRIAC can control the percentage of current that flows through a circuit load.

In some embodiments, the dimming control signal is a PWM signal for adjusting the driving current based on a duty ratio of the PWM signal. PWM refers to Pulse Width Modulation. PWM controlled power source is known to persons skilled in the art and persons skilled in the art may select any PWM component to implement this present invention based on the disclosure provided here.

In some embodiments, the lighting apparatus may also include a power supply 709 for providing a working power to the wireless module 707 and the detector 708.

In some embodiments, the detector has a priority setting for determining a priority order between the external control signal and the chopping signal.

In some embodiments, the priority setting controls the detector to output the dimming control signal completely based on the external control signal.

In some embodiments, the detector determines the dimming control signal according to the chopping signal with a ratio determined by the external control signal.

In some embodiments, when the external control signal is not received, the detector uses the chopping signal to determine the dimming control signal.

In some embodiments, the lighting apparatus may also include a manual switch 715 connected to the detector 708 for changing the priority setting.

In some embodiments, the chopping signal is converted to a digital value by the detector to determine the dimming control signal.

In some embodiments, the digital value corresponding to multiple control values respectively corresponding to multiple LED devices of the LED module to generate a mixed light.

In some embodiments, the multiple LED devices have different color temperatures, and a mixed color temperature of the mixed light is adjusted by changing the multiple control values.

In some embodiments, the driving current includes multiple sub driving currents, 7064, 7065, 7066 respectively supplied to the multiple LED devices 7061, 7062, 7063.

In some embodiments, the detector converted the chopping signal to the wireless module to generate a status signal sent to an external device.

In some embodiments, the external device generates the external control signal based on the status signal. In such embodiments, the wireless module 707 not only receives the external control signal, but also sends a status to the external device 710.

The external control signal has a set of commands sent to the detector. For example, when user rotates a TRIAC button, a chopping signal is generated. Usually, a TRIAC button is only used for increasing or decreasing a light intensity level. With such design, the TRIAC signal is interpreted with a different meaning by the detector, and also by the external device.

In other words, the external device and/or the detector may convert the chopping signal to different meanings based on a predetermined table or a configuration. When the set of commands are determined by the external device, the meaning may be changed even dynamically. The set of commands are electronic signals and thus are not particularly illustrated in the drawings but should be known to persons skilled in the art based on the disclosure.

In some embodiments, the detector determines the dimming control signal based on the set of commands to generate multiple sub driving currents to multiple LED devices of the LED module.

In some embodiments, different chopping signals correspond to different set of commands. For example, when the TRIAC rotator provides a value between 0 to 100, 0-10 may be converted to a first color temperature and 40-50 may be converted to a second color temperature.

The external device references a table to perform the mapping between the status signal and the set of commands. The table is a mapping relation stored in a storage device of the detector. The detector may be an integrated circuit chip and the storage is an embedded memory device.

In some embodiments, the external control signal has a value to disable reference to the chopping signal of the detector. In other words, in such case, no matter how users operate the TRIAC button, the final result is not related to the TRIAC button operation.

In some embodiments, the wireless module has a detachable antenna module 7071 and a wireless processor 7072.

The detachable antenna module 7071 is replaced with a different detachable antenna module to change a different wireless protocol but with the same wireless processor. In such embodiment, the wireless module may have a socket for plugging antenna modules of different protocols like Bluetooth, Zig-B and may be modified by plugging required antenna module while using the same wireless processor 7072.

Figure 1:
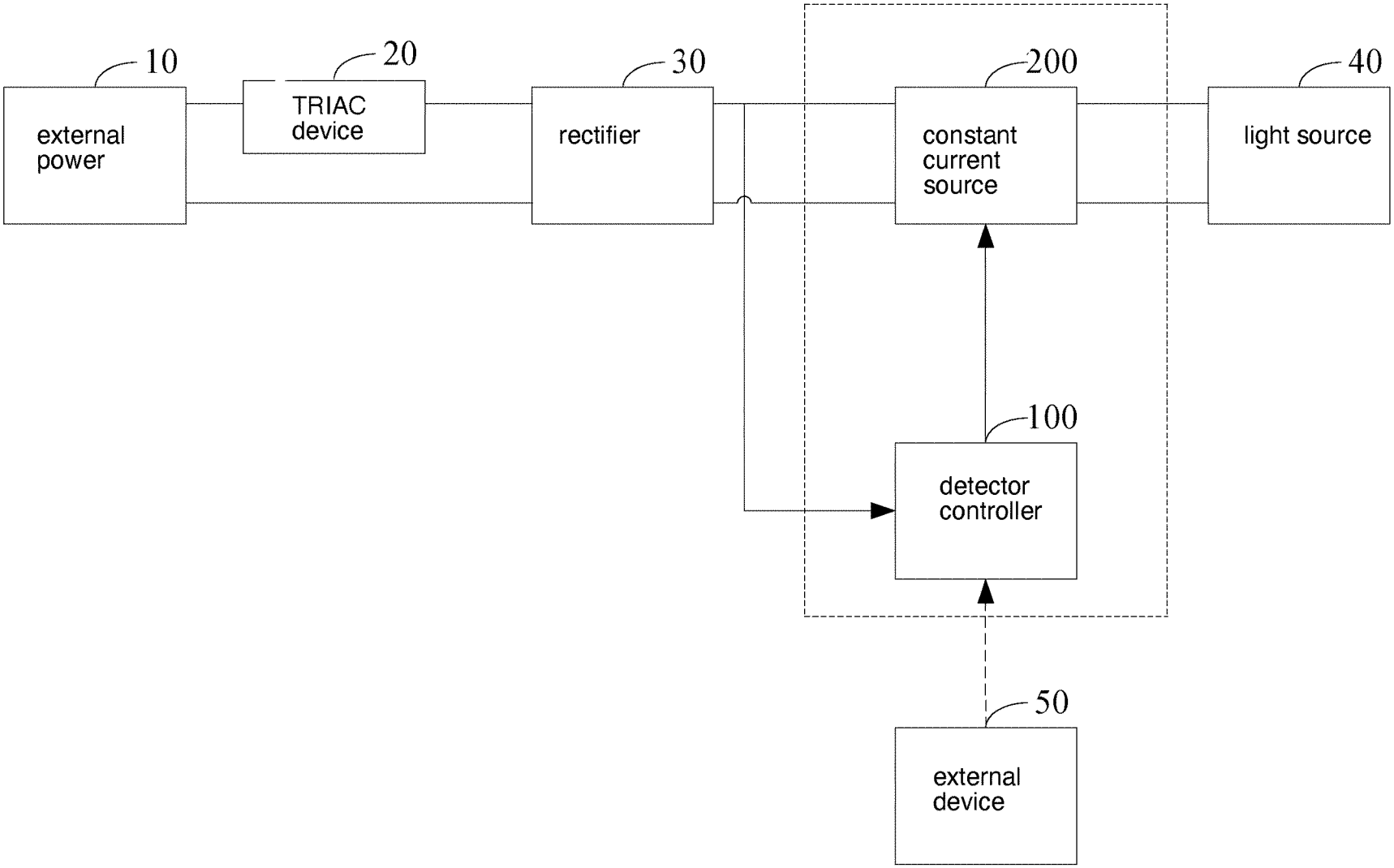
FIG. 1 illustrates a circuit flow diagram.

Please refer to FIG. 1, which shows a block diagram of a lighting apparatus embodiment. In FIG. 1, an external power 10 is connected to a TRIAC device 20 and a rectifier 30. Users may use a TRIAC button to operate the TRIAC device 20 to generate a chopping signal to adjust output of the rectifier 30, e.g. by changing a control angle and a conductive angle.

A dimming control device may include a constant current source 300 and a detector 100. The detector controller 100 receives an external control signal from an external device 50.

The detector detects a chopping signal of the TRIAC device 20 and the external control signal of the external device 50 to determine a final dimming control signal sent to the constant current source 200 to generate a corresponding driving current to the light source 40. For example, the constant current source 200 is a constant current source generator controlled by a PWM signal.

Figure 2:
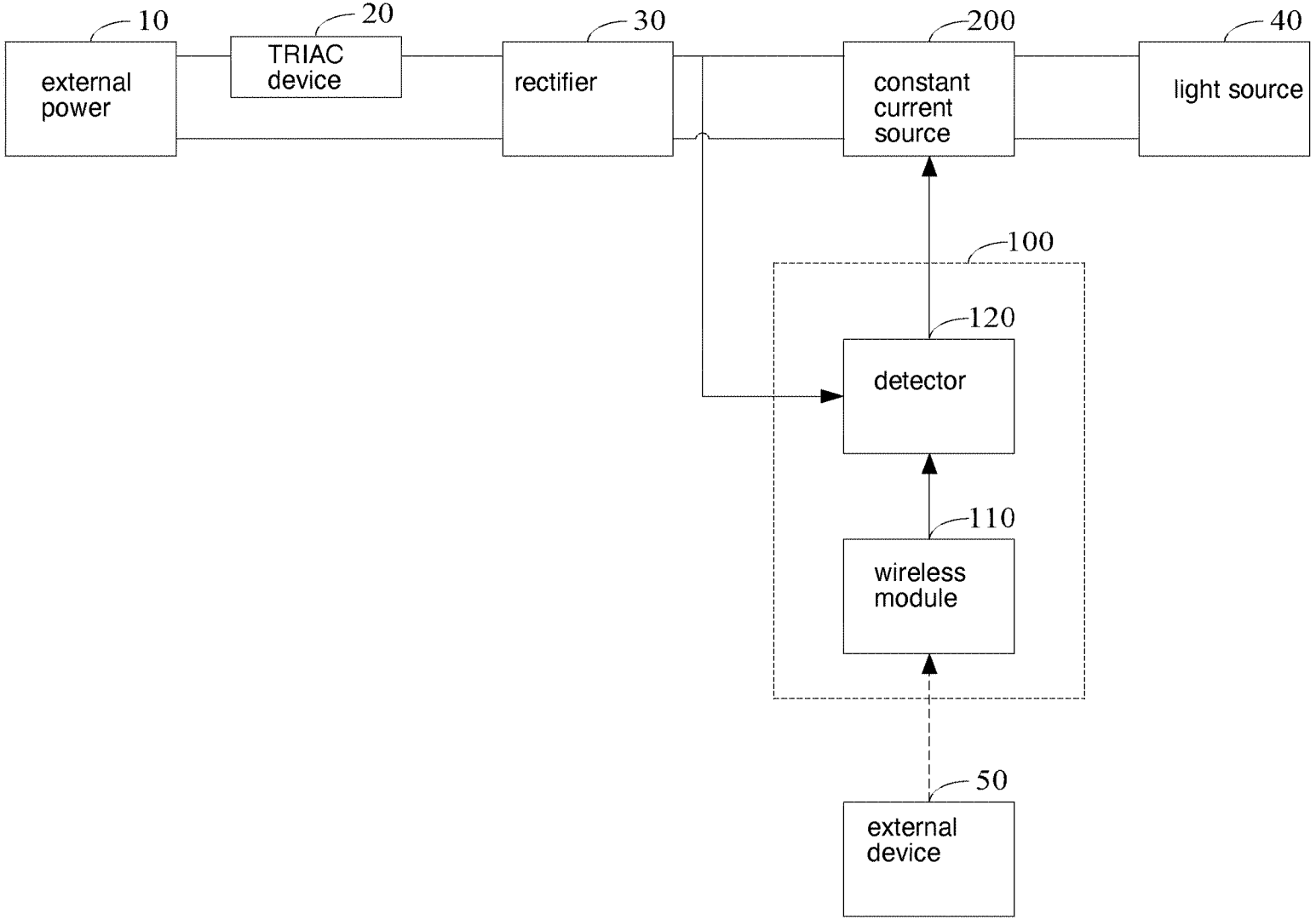
FIG. 2 illustrates a detailed example of the embodiment in FIG. 1.

FIG. 2 shows a more detailed example of FIG. 1. In addition to the components mentioned above, the detector controller 100 has a detector 120 and a wireless module 110.

Figure 3:
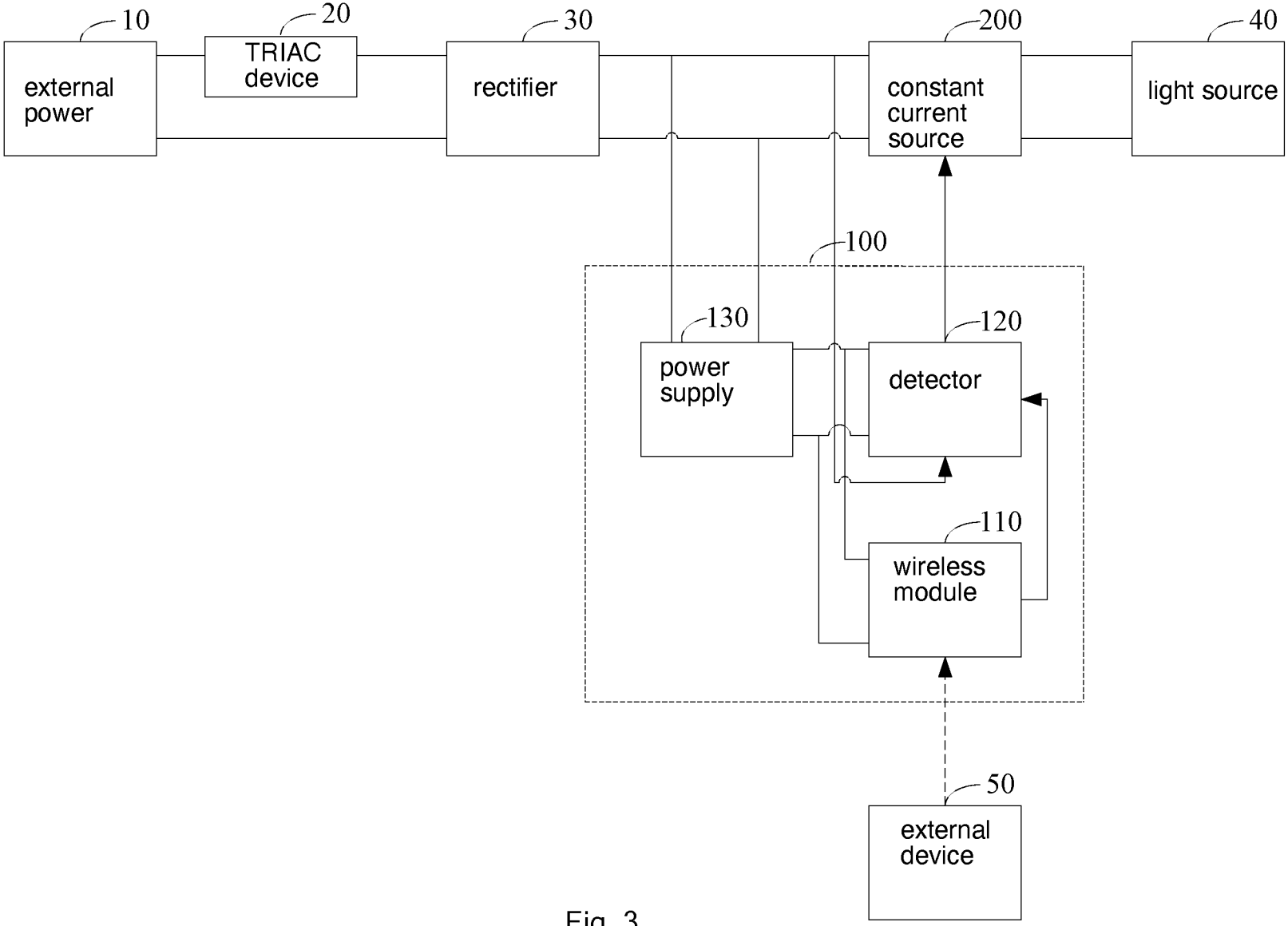
FIG. 3 illustrates another detailed example of the embodiment in FIG. 1.

FIG. 3 shows a variation of the example of FIG. 2. In addition to the components mentioned in FIG. 2, there is a power supply 130 to supplying proper power to the detector 120 and the wireless module 110.

Figure 4:
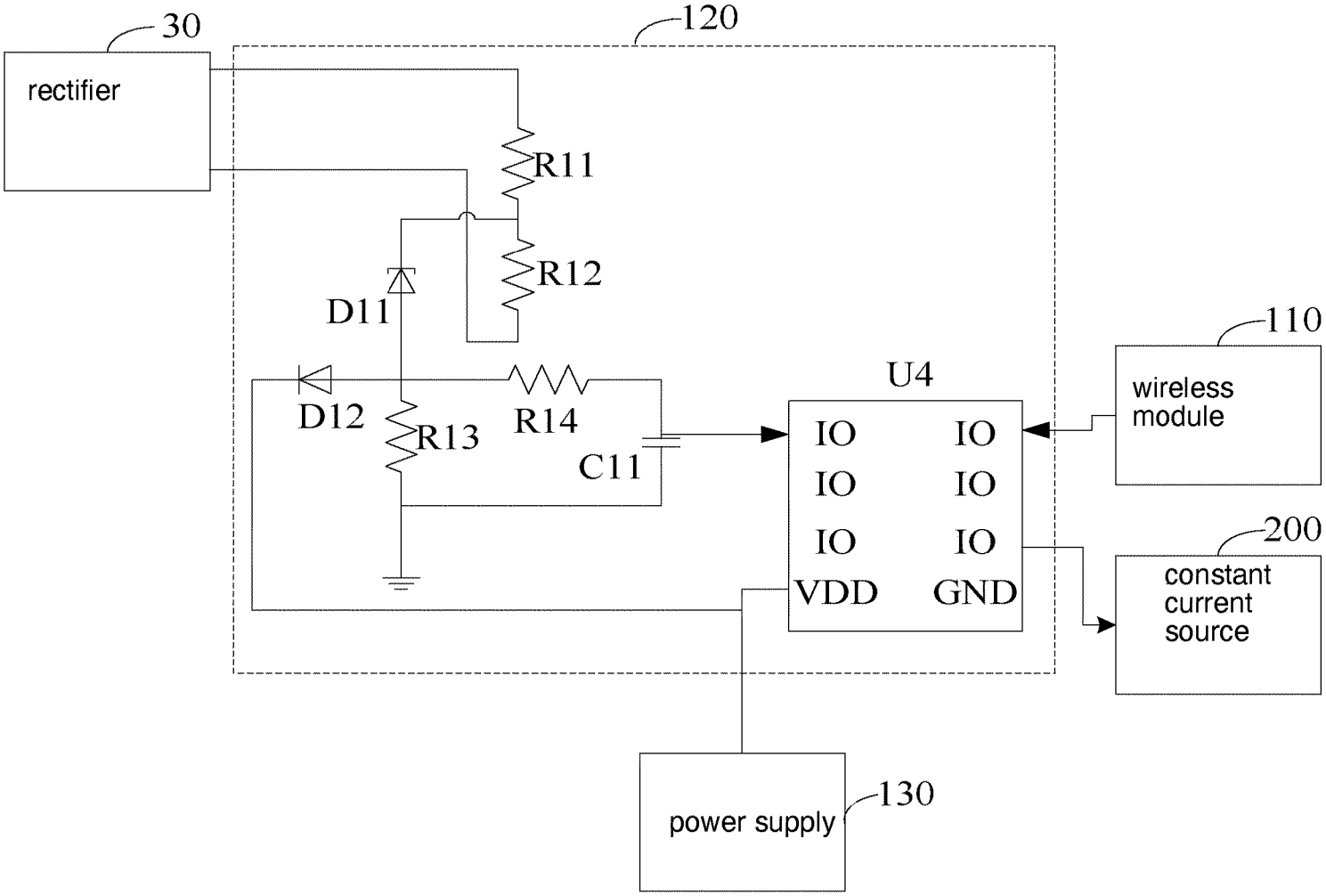
FIG. 4 illustrates a circuit diagram example of the embodiment in FIG. 1.

FIG. 4 shows an exemplary circuit diagram for the detector 120. The components in FIG. 3 are also illustrated for showing their relation to the components of the detector 120.

An integrated circuit U4 is connected to resistors R11, R12, R13, R14, capacitor C11, diodes D11, D12 for extracting the chopping signal in the generated direct current power. The external control signal is also received from the wireless module 110.

Figure 5:
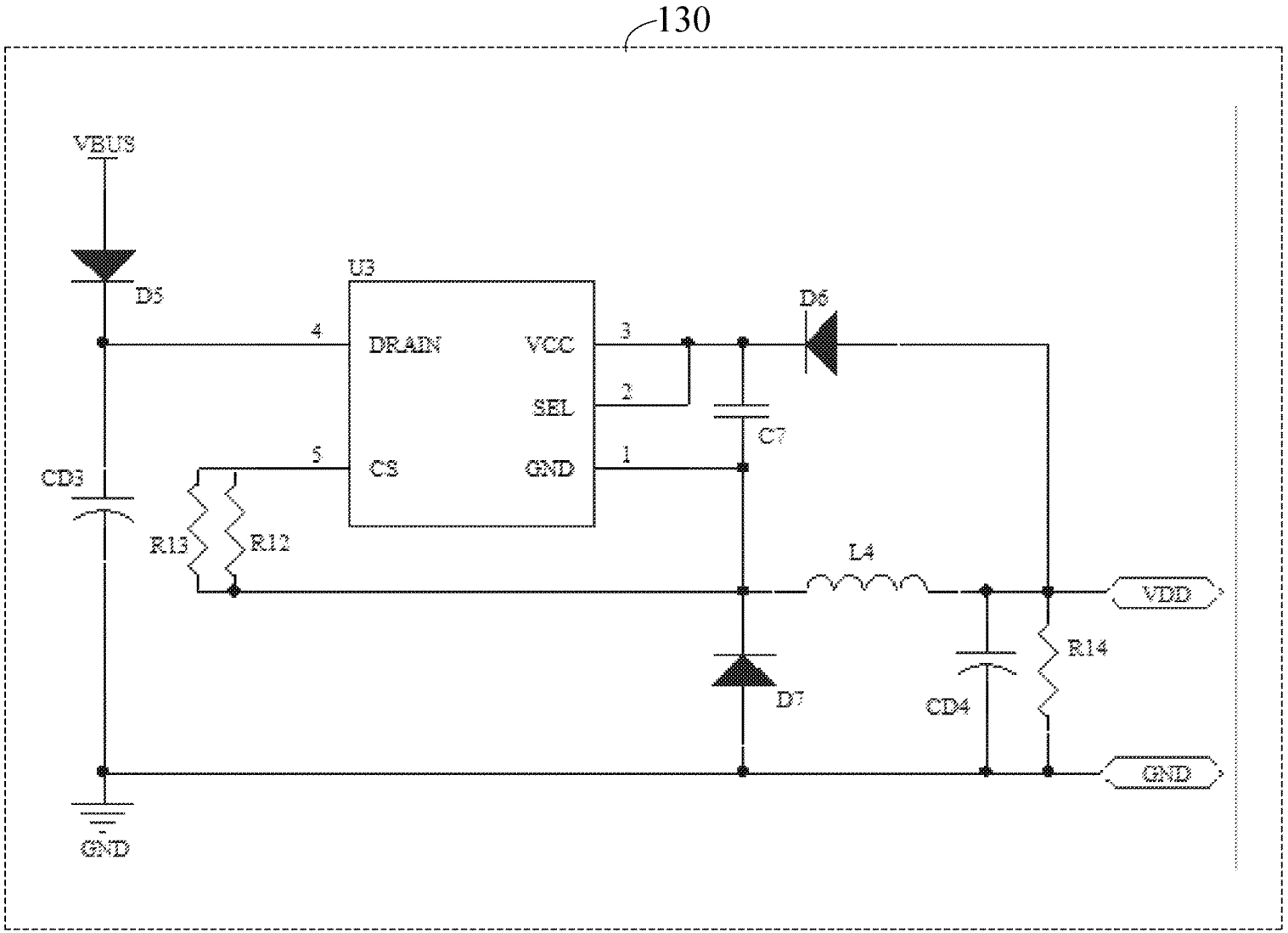
FIG. 5 illustrates another circuit diagram example for the embodiment in FIG. 1.

FIG. 5 shows a power supply 130 example diagram. In FIG. 5, an integrated circuit of power supply is connected to a diode D5, D6, D7, capacitors CD3, CD4, C7, conductor L4, resistors R12, R13, R14 to create a stable power providing to the detector and the wireless module.

Figure 6:
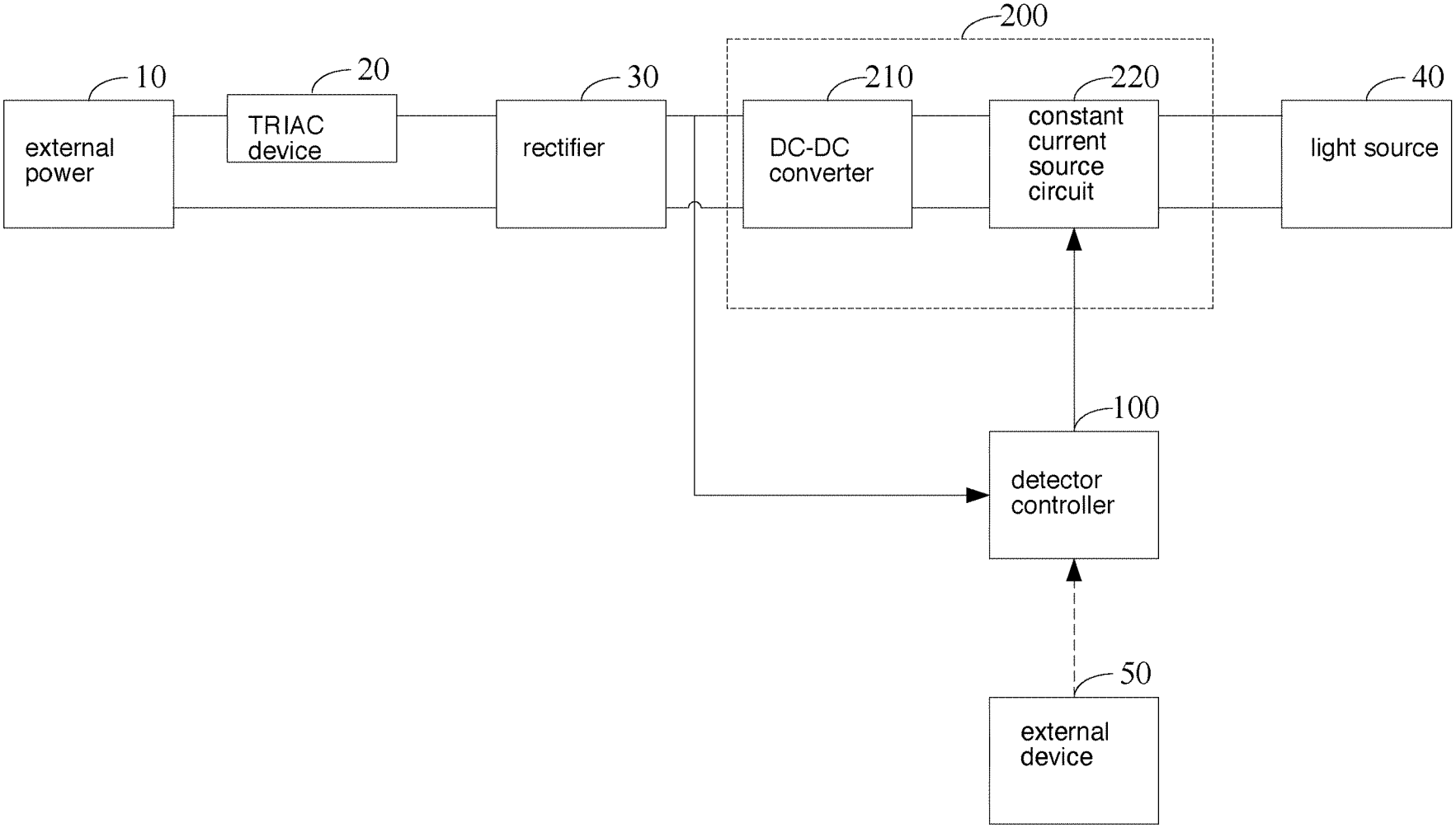
FIG. 6 illustrates another embodiment.

FIG. 6 shows another example. In FIG. 6, in addition to the components mentioned above, the constant current source 200 includes a DC-DC converter 210 and a constant current source circuit 220. The DC-DC converter working with the constant current source circuit makes a better driver circuit to improve light quality.

Figure 7:
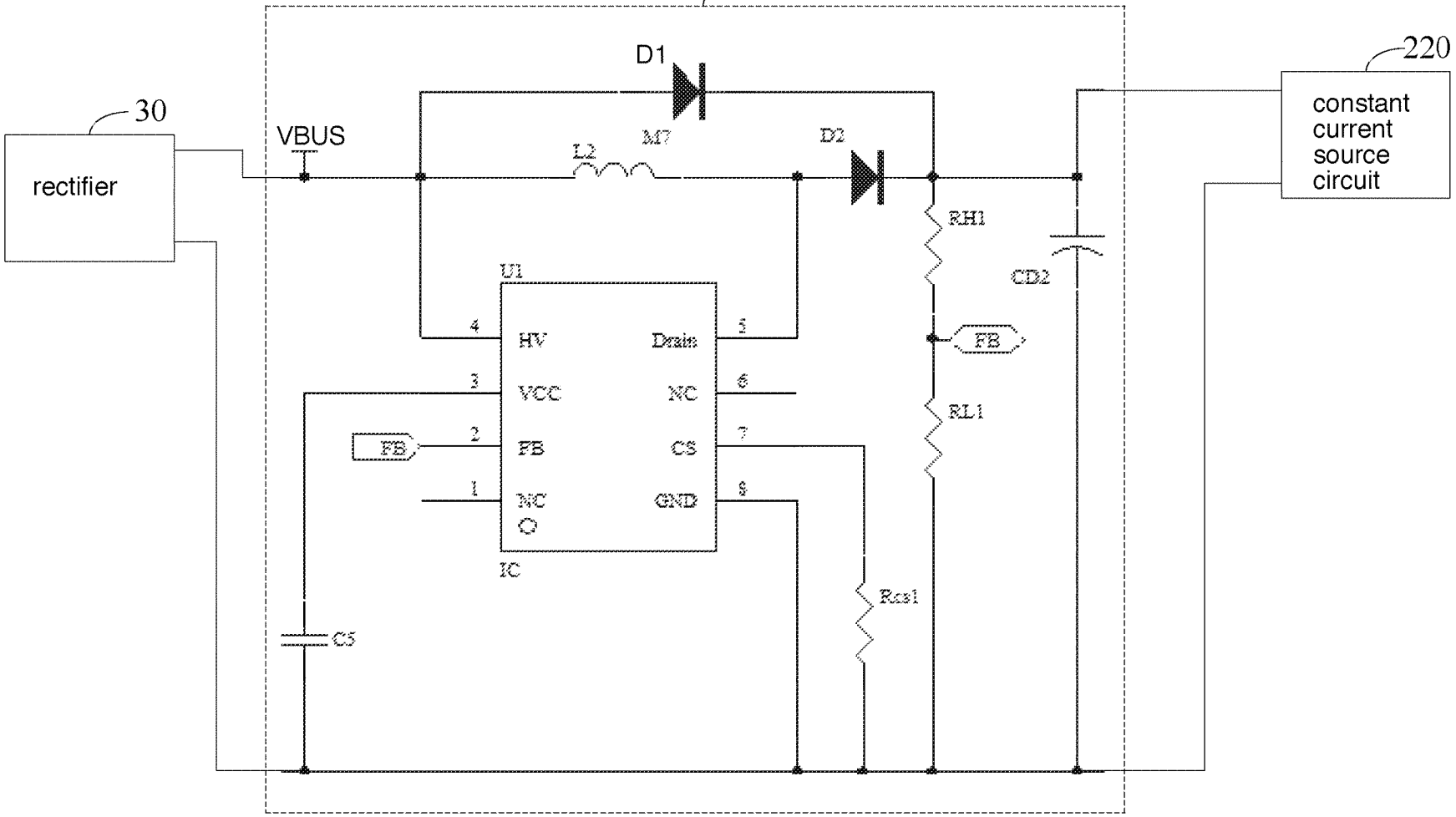
FIG. 7 illustrates a detailed circuit example of the embodiment of FIG. 6.

FIG. 7 shows a detailed example of the example in FIG. 6. In FIG. 7, the DC-DC converter 210 has diodes D1, D2, conductor L2, capacitors CD2, C5, resistors RCS1, RL1, RH1 to provide a DC-DC power conversion.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus for receiving an alternating current power, comprising:

a LED module;

a constant current source providing a driving current to the LED module;

a bridge rectifier for converting the alternating current power of a first frequency to a direct current power with a second frequency, wherein the second frequency is two times of the first frequency;

a silicon-controlled rectifier connected to the alternating current power and the bridge rectifier for adjusting the direct current power with a chopping signal;

a wireless module for receiving an external control signal; and a detector for generating a dimming control signal supplied to the constant current source to adjust the driving current according to both the external control signal and the chopping signal, wherein the detector converted the chopping signal to the wireless module to generate a status signal sent to an external device, wherein the external device generates the external control signal based on the status signal, the external control signal has a set of commands sent to the detector.

2. The lighting apparatus of claim 1, further comprising a DC-DC converter for converting the direct current power source to a constant direct current supplied to the constant current source.

3. The lighting apparatus of claim 1, wherein the silicon-controlled rectifier is a TRIAC device, and the chopping signal is a TRIAC signal corresponding to a conductive angle for conducting a ratio of a current of the bridge rectifier.

4. The lighting apparatus of claim 1, wherein the dimming control signal is a PWM signal for adjusting the driving current based on a duty ratio of the PWM signal.

5. The lighting apparatus of claim 1, further comprising a power supply for providing a working power to the wireless module and the detector.

6. The lighting apparatus of claim 1, wherein the detector has a priority setting for determining a priority order between the external control signal and the chopping signal.

7. The lighting apparatus of claim 6, wherein the priority setting controls the detector to output the dimming control signal completely based on the external control signal.

8. The lighting apparatus of claim 6, wherein the detector determines the dimming control signal according to the chopping signal with a ratio determined by the external control signal.

9. The lighting apparatus of claim 6, wherein when the external control signal is not received, the detector uses the chopping signal to determine the dimming control signal.

10. The lighting apparatus of claim 6, further comprising a manual switch connected to the detector for changing the priority setting.

11. The lighting apparatus of claim 1, wherein the chopping signal is converted to a digital value by the detector to determine the dimming control signal.

12. The lighting apparatus of claim 11, wherein the digital value corresponding to multiple control values respectively corresponding to multiple LED devices of the LED module to generate a mixed light.

13. The lighting apparatus of claim 12, wherein the multiple LED devices have different color temperatures, and a mixed color temperature of the mixed light is adjusted by changing the multiple control values.

14. The lighting apparatus of claim 13, wherein the driving current includes multiple sub driving currents respectively supplied to the multiple LED devices.

15. The lighting apparatus of claim 1, wherein the detector determines the dimming control signal based on the set of commands to generate multiple sub driving currents to multiple LED devices of the LED module.

16. The lighting apparatus of claim 15, wherein different chopping signals correspond to different set of commands, the external device references a table to perform the mapping between the status signal and the set of commands.

17. The lighting apparatus of claim 1, wherein the external control signal has a value to disable reference to the chopping signal of the detector.

18. The lighting apparatus of claim 1, wherein the wireless module has a detachable antenna module and a wireless processor, the detachable antenna module is replaced with a different detachable antenna module to change a different wireless protocol but with the same wireless processor.

* * * * *